US006609064B1

(12) United States Patent
Dean

(10) Patent No.: US 6,609,064 B1
(45) Date of Patent: Aug. 19, 2003

(54) SYSTEM AND METHOD FOR GROUPING GPS DATA INTO MOVING AND STATIONARY SEGMENTS

(75) Inventor: Vincil C. Dean, Louisville, CO (US)

(73) Assignee: Qwest Communications Int'l, Inc., Denver, CO (US)

( * ) Notice: Subject to any disclaimer, the term of this patent is extended or adjusted under 35 U.S.C. 154(b) by 0 days.

(21) Appl. No.: 09/386,756

(22) Filed: Aug. 31, 1999

(51) Int. Cl.[7] ..... G06G 7/78
(52) U.S. Cl. ..... 701/213; 342/357.06
(58) Field of Search ..... 701/29, 35, 213, 701/208; 340/438, 439; 342/357.06, 357.07, 357.08, 357.09

(56) References Cited

U.S. PATENT DOCUMENTS

| | | | | | |
|---|---|---|---|---|---|
| 5,491,486 | A | * | 2/1996 | Welles, II et al. | 342/357 |
| 5,493,499 | A | * | 2/1996 | Theurer et al. | 364/449 |
| 5,512,904 | A | * | 4/1996 | Bennett | 342/357 |
| 5,638,077 | A | * | 6/1997 | Martin | 342/357 |
| 5,712,899 | A | * | 1/1998 | Pace, II | 379/58 |
| 5,777,580 | A | * | 7/1998 | Janky et al. | 342/457 |
| 5,791,294 | A | * | 8/1998 | Manning | 119/721 |
| 5,828,987 | A | * | 10/1998 | Tano et al. | 702/150 |
| 5,974,356 | A | * | 10/1999 | Doyle et al. | 701/209 |
| 5,991,692 | A | * | 11/1999 | Spencer et al. | 701/217 |

* cited by examiner

*Primary Examiner*—Tan Nguyen
*Assistant Examiner*—Dalena Tran
(74) *Attorney, Agent, or Firm*—Marsh Fischmann & Breyfogle, LLP

(57) ABSTRACT

A system provides the ability to collect and analyze data generated by a global positioning system to assist in monitoring and supervising a user of a vehicle. The system includes a GPS unit incorporated into a vehicle for periodically generating and recording information with regard to the position and velocity of the vehicle. The recorded information is periodically transferred to a remotely located computer via a wireless communications system, within which a grouping program is implemented. The grouping program is used to identify periods where the vehicle is in a stationary mode and periods where the vehicle is in a moving mode traveling from one location to another, based on the information provided by the GPS unit. The system generates a summary in map or report format. The results of the grouping program may be presented on map images representing the area within which the vehicle traveled. Symbols are drawn onto the map images corresponding to the locations of the stationary segments. Between the stationary segment symbols, travel paths are drawn using the positional information obtained by the GPS unit. The grouping program is also configured to generate a summary report pertaining to the travel information of the vehicle, such as the percentage of time spent driving versus the percentage of time spent working at job sites.

31 Claims, 5 Drawing Sheets

SYSTEM AND METHOD FOR GROUPING GPS DATA INTO MOVING AND STATIONARY SEGMENTS

FIELD OF THE INVENTION

The present invention generally relates to a method and system for processing data, and, in particular, to a method and system for grouping data provided by a global positioning system.

BACKGROUND OF THE INVENTION

Many companies today employ field representatives to provide services to remote locations. The field representatives spend a significant portion of their work time driving from one job site to another. These companies are faced with the challenge of making the most economical use of the field representatives' valuable work time by minimizing their travel time between job assignments. Thus, it may be desirable to monitor the field representatives' work time in order to determine how efficiently they are being utilized. Information gained from monitoring may provide guidance on how to improve the use of their time. However, because field representatives spend most of their time at remote locations away from direct observation, the monitoring of their movements may be difficult to accomplish.

One way to monitor field representatives is to equip fleet vehicles with global positioning system (GPS) equipment. The GPS periodically reports vehicle's position to a central office. The position information may be used to optimize the allocation of job assignments. One problem faced with the use of GPS in fleet vehicles is the difficulty associated with manually processing data supplied by the GPS units to evaluate work performance as well as providing guidance on how to make the most economical use of field representatives. During the course of a working day, a GPS system associated with a fleet vehicle may generate large quantities of data regarding location and velocity of the vehicle. If the amount of data supplied by one GPS unit is multiplied by the number of fleet vehicles employing GPS, it is easy to recognize what a resource intensive process it would be to manually analyze the data. Not only is the manual processing of the GPS data time-consuming, but it may be subject to human error.

SUMMARY OF THE INVENTION

The inventor has recognized that data reported by a global positioning system (GPS) may be processed to identify certain information. When the positional information of a movable object is periodically collected, certain processing operations may be performed in order to identify time intervals during which the movable object is stationary and time intervals during which the movable object is moving.

The present invention is directed to a method and system for collecting and analyzing positional data to facilitate monitoring of a movable object. The system may include a GPS unit located on the moving object, such as a service truck, which collects and stores positional data. The GPS unit may include a GPS receiver which generates positional information, such as latitude and longitude, of the movable object on a periodic basis. Also included in the GPS unit may be a memory which stores the positional data supplied by the GPS receiver. Based on the positional information supplied by the receiver, the system identifies time intervals during which the movable object is moving and time intervals during which the vehicle is stationary. The collecting, storing and processing of the GPS data may be performed by a single device or by separate devices.

In one aspect of the invention, the system described herein may be used to monitor a fleet of vehicles as they move from one location to another. The GPS information may be grouped into moving segments indicative of a vehicle traveling from one location to another and stationary segments indicative of a vehicle being stopped at one location for an extended period of time. The derived moving and stationary segments may be useful in determining whether the vehicles or the field representatives operating the vehicles are being effectively utilized. This may be accomplished by comparing the percentage of their time spent moving and the percentage of their time spent stationary. The stationary segments may provide useful insight into behaviors and habits. For example, the stationary segments may represent trouble spots where problems arise frequently or may also represent unusually long breaks taken by field representatives. The stationary segments may also serve to indicate that additional training is needed. For example, the processed information may indicate that a particular field representative is making frequent visits to a particular location, e.g. the company's parts and equipment pickup facility. Such frequent visits may suggest that the field representative needs further training, for example, to better anticipate what parts and equipment will be required to complete the assigned services.

In another aspect of the invention, the grouping process may be accomplished with a computer system remotely located relative to the GPS unit. The data collected by the GPS unit may be transferred to the remotely located computer system, using a number of different modes of communication. For example, a wireless communications network may be utilized to periodically transfer the stored data from the GPS unit to the computer system performing the analysis. In this case, both the GPS unit and the remotely located computer system have wireless data communications capabilities to transmit and receive wireless signals to/from each other. Alternatively, the collected data may be copied onto a data transfer medium, such as a magnetic or optical disk, and manually loaded onto the remotely located computer.

In a further aspect of the invention, the system may utilize a GPS receiver which is capable of providing velocity information as well as geographic positional information. The velocity information provided by the GPS receiver may be recorded along with the positional information. The velocity information is used by the system to facilitate identifying moving and stationary segments. In addition to the velocity information, time information, representative of the time associated with corresponding positional and velocity information, may also be included in the GPS data. The time information serves to indicate the times of the day corresponding to the start and end of stationary and moving segments or measurement of relevant intervals.

In yet another aspect of the invention, the grouping process may be performed by a grouping module which is part of the computer system. The grouping module may be configured to identify stationary segments by examining each portion of GPS data sequentially. First, the processing module may identify consecutive portions of the GPS data which are associated with the vehicle moving at less than a predetermined velocity. Next, the processing module may calculate a time interval corresponding to each of the identified portions of consecutive GPS data. If the time interval exceeds a predetermined time interval, such identified portion of GPS data is recognized as a stationary segment. The processing module may recognize stationary segments by recording a start time, an end time and a location corresponding to each of the identified stationary segments. The grouping module may also recognize moving segments by recording start and end times and locations corresponding thereto, based on the time and location information associated with previous and subsequent stationary segments. In this regard, the grouping module allows a computer to analyze large quantities of data, summarizes the data into a desired format, which provides for a more simplified analysis of the performances of field agents.

In yet another aspect of the invention, the system described herein may be used to monitor any movable objects. The present system has application to substantially any situation where positional information is periodically available and where it is desirable to distinguish stationary segments from moving segments. For instance, the present system may be used in tracking the behavior and habits of an animal. A GPS receiver may be attached to the body of the animal to periodically collect positional and velocity data of the animal as it moves from one location to another. In this way, the present system facilitates processing the GPS data to provide further insight into the behavior and habits of the animal by allowing a user to readily observe the location and time of the day the animal rests, as well as the travel paths between resting intervals.

In yet another aspect of the invention, other types of information may be obtained from the vehicle in addition to the positional information. One example may be the on/off status of the ignition system of a vehicle. This information may be useful in determining time intervals during which the vehicle is stationary. In this case, the GPS unit may be operatively coupled to periodically receive information pertaining to the on/off status of the ignition system and store the received ignition status information in the memory thereof. The grouping module may be configured to assume that the vehicle is in a stationary mode whenever the ignition is turned off. Accordingly, at least the time intervals associated with the ignition being off may be recognized as stationary periods. In one embodiment, when the vehicle is parked with the ignition off, the GPS unit may be programmed to collect one more GPS data point and to turn itself off in order to avoid exhausting the electrical power supply of the vehicle. For purposes of reporting its current location upon arrival at each job site location, the GPS unit may be configured to automatically transmit the GPS data to the central office via a wireless communications network each time the vehicle is parked with the ignition off.

In yet another aspect of the invention, the grouping module processes large quantities of GPS data and presents the output results in a predetermined format. In one embodiment, a report is generated based on the identified stationary and moving segments. The report may include information regarding start and stop time and locations of each of the moving and stationary segments. The report may also contain other relevant summary information such as the percentage of the time each field representative spends driving between work sites versus the time spent performing services at the work sites. The identified stationary and moving segments may also be displayed on a map with symbols drawn on the map corresponding to the locations of the stationary segments and/or moving segments. Each of the symbols may be labeled with corresponding start and stop times in order to indicate when each stop is made and the duration thereof. The moving segments may be represented by travel paths plotted between the symbols using the positional information obtained by the GPS unit. In this regard, the user may draw analytical conclusions about how effectively service representatives are being utilized based on the information derived by the grouping module.

In yet another aspect of the invention, the grouping program may include a user interface which allows for selection and changing of the predetermined parameters used in the program. In this way, a user may adjust the parameter values such that the output results obtained from the grouping program most accurately reflect the actual facts with regard to stationary and moving segments. The user interface may be further configured to permit the user to select the way in which the output results are presented.

DETAILED DESCRIPTION

Figure 1:
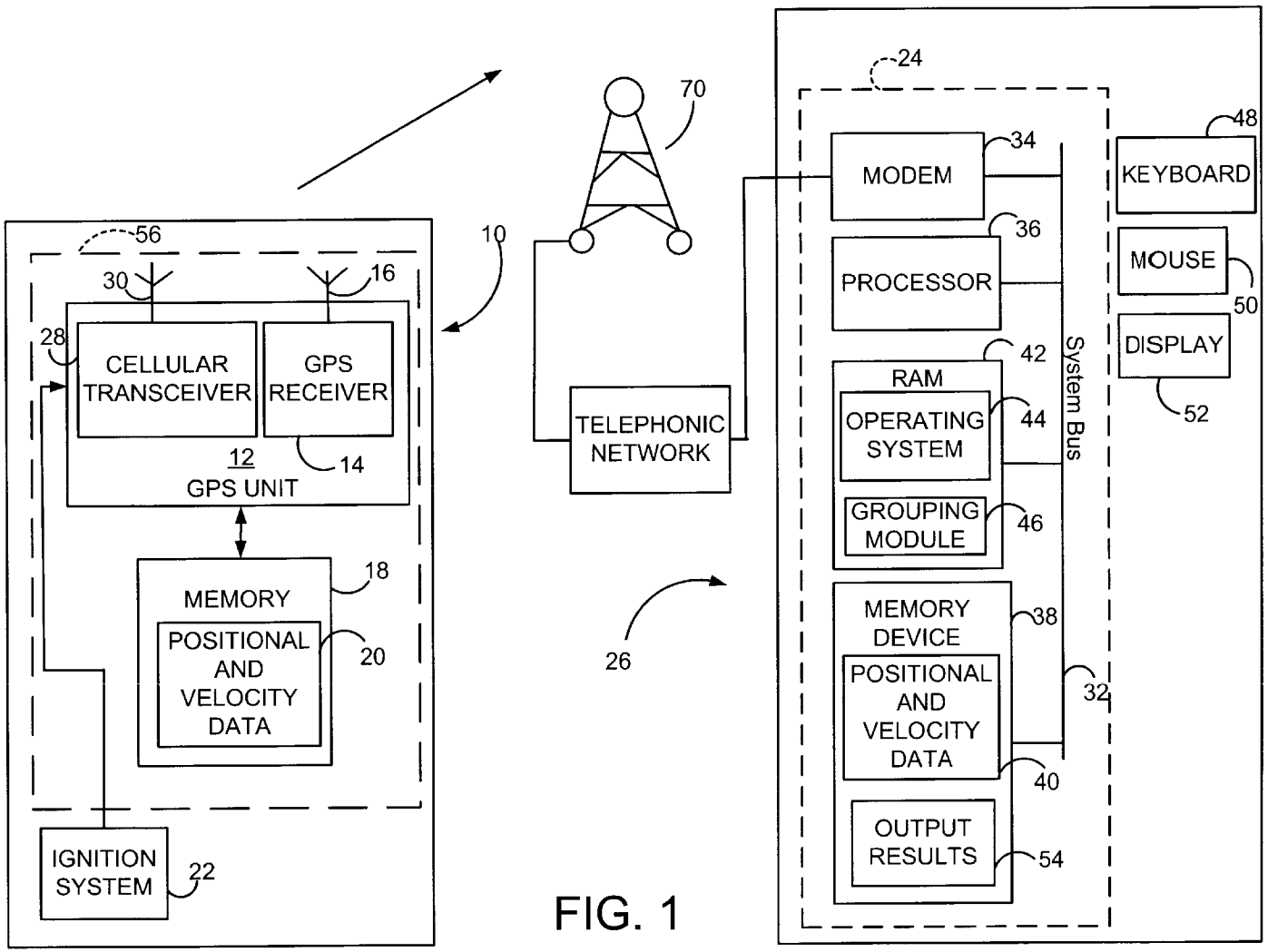
FIG. 1 is a block diagram illustrating a system for collecting and grouping vehicle location data in accordance with the present invention.

Referring to FIG. 1, a system for collecting and processing GPS data according to the present invention is shown. In communications with the system is a movable object, such as a vehicle which is generally designated 10. The vehicle 10 is equipped with a GPS unit 12 for providing latitude and longitude data. The GPS unit is configured to provide positional data on a periodic basis; for example, once every minute. The GPS unit 12 includes a GPS receiver 14 connected to a GPS antenna 16 for receiving data signals transmitted from GPS satellites. Based on the data signals received from the GPS satellites, a geographic position may be determined by performing known triangulation calculations. The GPS unit 12 is preferably of a type capable of providing velocity information in addition to positional information. While the embodiment described herein obtains velocity data from the GPS unit, it should be noted that velocity data can be obtained directly from a preexisting instrument of the vehicle or a velocity sensor incorporated thereunto.

As shown in FIG. 1, the GPS unit 12 is in connection with a memory 18 to store positional and velocity data 20. Included in the GPS unit is a processor (not shown) which controls operations of generating GPS data as well as operations of storing the GPS data into the memory. The GPS data may be time-stamped to indicate a particular time of the day at which each positional and velocity data is generated. As shown in FIG. 1, the GPS unit may be operatively coupled to the ignition system 22 of the vehicle to periodically receive information pertaining to the status of the ignition system. The GPS unit periodically receives and records in the memory the following information: the time of day, the latitude and longitude data, velocity information, and the on/off status of the ignition system. For purposes of conserving the electrical power supply of the vehicle, the GPS unit may be configured such that the GPS receiver generates GPS data only when the ignition system is activated and turns itself off shortly after the ignition system is deactivated. Because it is generally safe to assume that the vehicle is stationary while the ignition is off, it may be unnecessary to collect data during this period. Also included in the GPS unit 12 is a wireless network controller such as a cellular transceiver 28, which is connected to a cellular antenna 30 for transmitting and receiving wireless data signals. The wireless communications network may comprise any suitable network such as a cellular communications network, personal communication systems (PCS), radio frequency communication networks or satellite communications.

Data signals transmitted over the communications network are received and processed by a computer 24 in which a grouping program of the present invention is implemented. The computer 24 is remotely located with respect to the vehicle 10, such as at a central office which is generally designated 26. The GPS data 20 stored in the memory 18 is periodically transferred to the computer 24 via a wireless communications network when analysis of the GPS data is desired. Instead of transmitting data via a wireless network, the collected data may be copied onto a data transfer medium such as a magnetic or optical disk and physically carried and loaded onto a computer at the central office.

For purposes of reporting current positional information to the central office, the GPS unit may be configured to automatically establish a wireless connection with the computer 24 at the central office and transmit GPS data at predetermined time intervals; for example, once every hour. In one embodiment, the GPS unit may be configured to transmit accumulated data once the vehicle is parked with the ignition off. In this embodiment, the GPS unit is preferably programmed to collect at least one more positional reading after the ignition is deactivated so as to ensure that at least one GPS data point corresponds to the parked location. As an example of how the GPS data is used at the central office, the GPS data received at the central location may be used by an interactive dispatch system to select and dispatch job assignments that are in close proximity to the location of the field representative associated with the GPS unit.

The computer 24 at the central office 26 may be any computer capable of performing sequential program execution, including personal computers, minicomputers or mainframes. The computer 24 includes a system bus 32 to which various components are coupled, such as a modem 34 for establishing a data connection with the GPS unit via a wireless communication network. The wireless communication network includes a wireless tower 70 for receiving wireless signals and relaying the received signals to a telephonic network 72, which routes the signals to the modem. The computer 24 also includes a processor 36 and a memory device 38 which stores, among other things, the GPS data 40 provided by the GPS unit 12. The memory device 38 may be of any suitable storage device such as a hard drive, floppy disk drive, tape unit, CD-ROM and the like. Connected to the processor 36 is a random access memory (RAM) 42 into which an operating system 44 and the grouping program of the invention are loaded. Also connected to the system bus 32 are input devices such as a keyboard 48 and a mouse 50 and a display unit 52.

In operation, field representatives may use fleet vehicles to move from one job site to another, alternating between moving and stationary time intervals. At least while the ignition is turned on, the GPS unit receives and records positional and/or velocity information. The recorded data is periodically transmitted to the central office via a wireless communication network. At the central office, the computer 24 is used to analyze data received from the GPS units in the fleet vehicles. In particular, the computer processes the GPS information to identify moving and stationary segments. Based on the derived moving and stationary segment information, the computer may be configured to generate a summary of how a particular field representative is being utilized by calculating the percentage of the work time being used for driving and the percentage of the work time being used at work sites. The stationary intervals may represent trouble spots, such as where there are recurring problems, or they may represent unusually long or frequent breaks.

Figure 2:
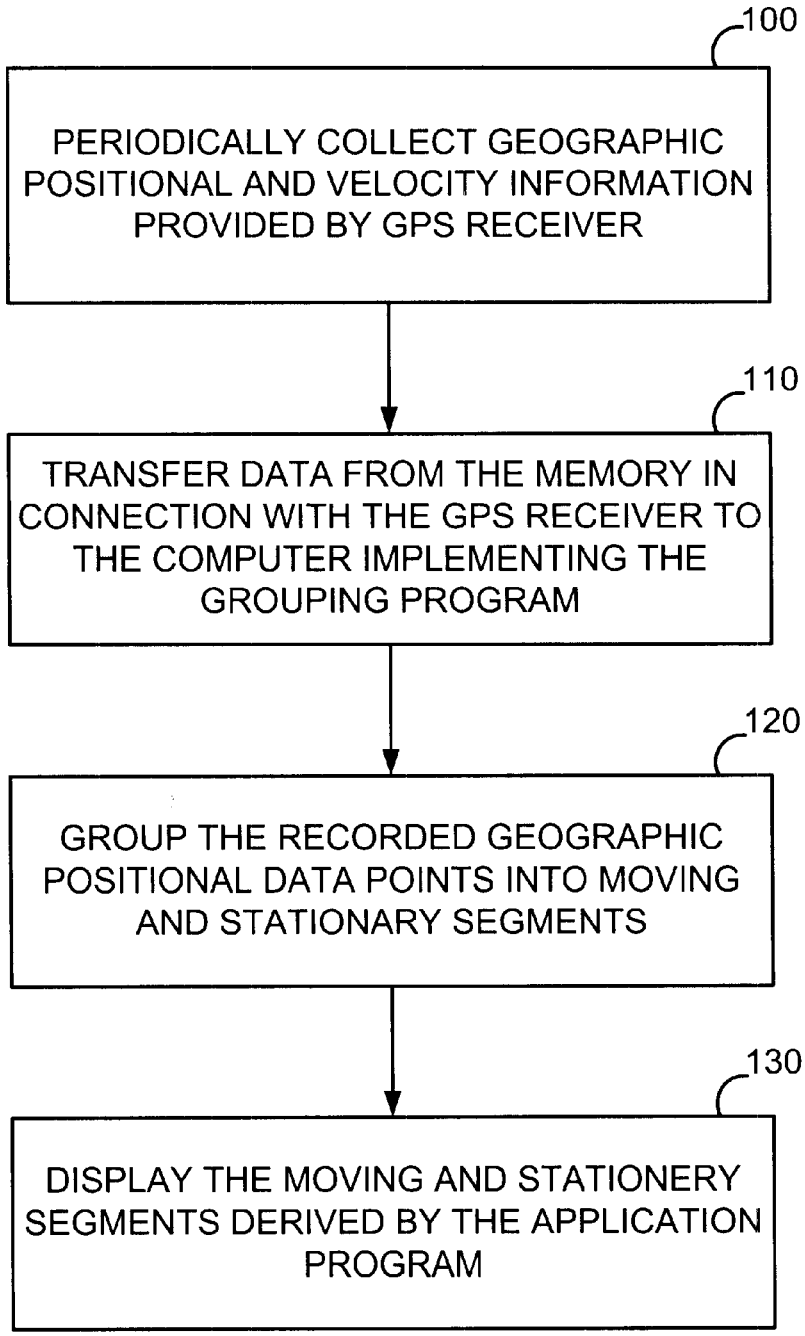
FIG. 2 is a flowchart diagram illustrating the general steps of collecting and grouping geographical positional information.

Referring to FIG. 2, the general steps of collecting and grouping GPS data according to the present invention is shown. In step 100, the GPS receiver 14 is used to generate positional and velocity data on a periodic basis. The data collected by the GPS receiver 14 is transferred to the computer 24 at the central office 26 in step 110. In step 120, the computer 24 then processes the GPS data to determine such things as vehicle speed, distance traveled between two data points, on/off status of ignition system 22, and duration of stationary time intervals. The steps performed in FIG. 2 provides an automated process for identifying the time periods during which the vehicle 10 is in a traveling mode and time periods during which the vehicle is in a stationary mode. In step 130, the moving and stationary segments derived by the computer are visually presented on a display device or are used to generate a report.

Figure 3:
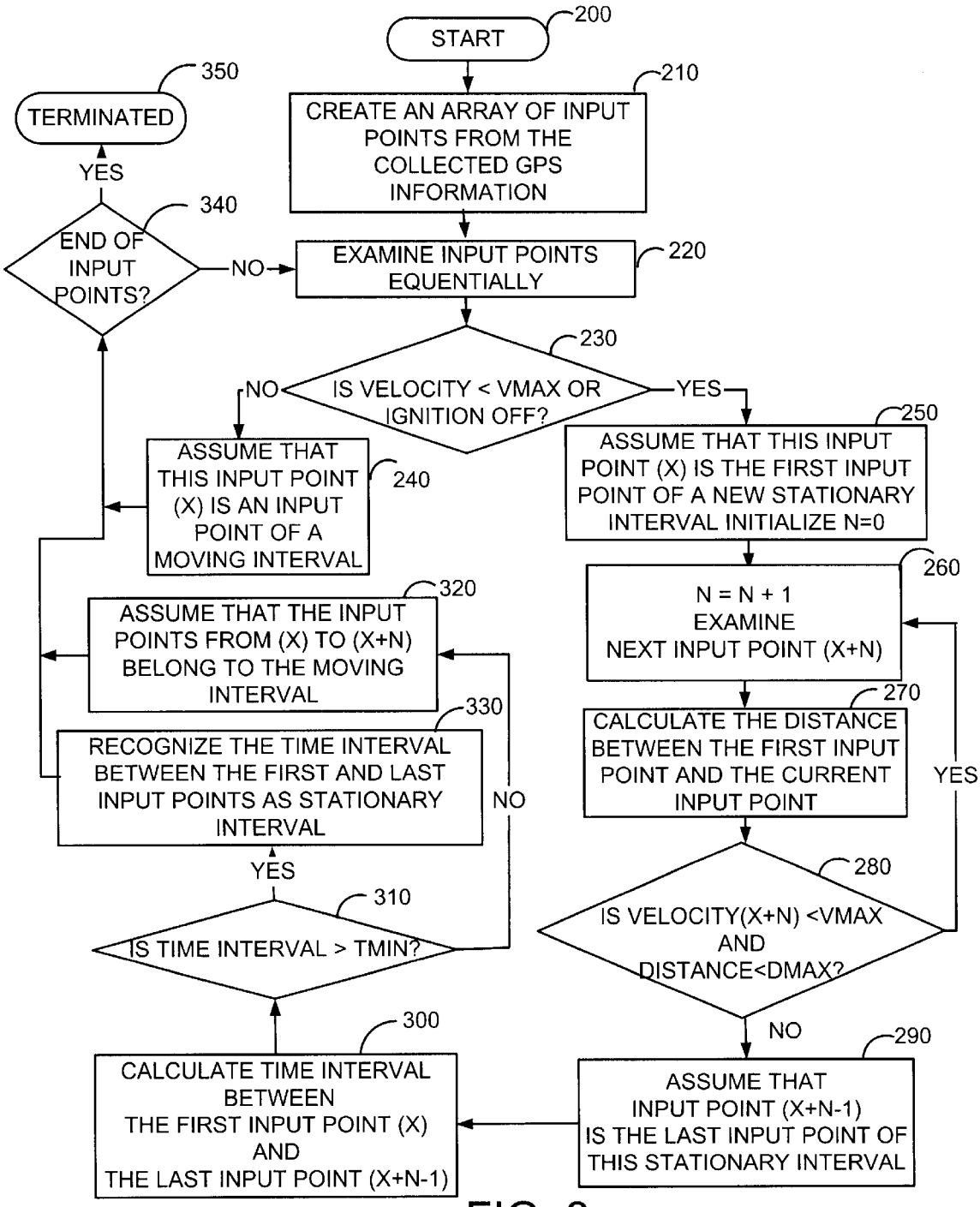
FIG. 3 is a flowchart diagram illustrating the process of a grouping program of the present invention.

The step 120 is performed by grouping module 46 on the computer 24. Disclosed in FIG. 3 is a flowchart diagram of a grouping program according to the present invention. The execution of the grouping program begins at step 210, where the application program reads the GPS data stored in the memory device 38 and creates an array of input points. Each input point in the array includes information with regard to the geographic location and velocity of the vehicle and a corresponding time at which the location and velocity information is recorded. The input points are examined sequentially starting in step 220 in order to determine whether the current input point belongs to a moving or stationary segment. The velocity component of the current input point is first compared with a maximum value of velocity ("VMAX") in step 230. The VMAX is a predefined value, for example, specified in miles per hour, to represent a velocity below which the vehicle is considered stationary. For purposes of compensating for possible error or noise in the data provided by the GPS system, the value of VMAX may be selected at some positive number, such as five miles per hour. A moving segment may be inferred when the velocity reported by the GPS unit exceeds a certain limit, or when the distance between two consecutive data exceeds a certain limit. Accordingly, if the velocity component of the input point is greater than or equal to VMAX (step 230, NO), the input point is assumed to be part of a moving segment.

One way of recognizing a stationary interval is by monitoring the velocity component of the input points. If the velocity component is less than VMAX (step 230, YES), the input point is assumed to be part of a stationary interval. Another way of recognizing a stationary interval is by monitoring the on/off status of the ignition system. If the input point at step 230 indicates that the ignition is off (step 230, YES), the input point is assumed to be part of a new stationary interval. Any sequence of input points, starting from the first input point indicating that the ignition is off until at least the first input point indicating that the ignition is turned on, may be recognized as a stationary interval. However, a moving segment may not be recognized based only on the status of the ignition system since it is possible that a field representative may drive to a field site, leave the ignition on, and do the work, then drive away.

Once a first input point of a stationary segment is identified, a counter N is initialized; i.e., the counter is set to zero (step 250). At this point, the grouping program proceeds in a loop to include additional input points which appear to be input points belonging to the current stationary segment. The loop comprises a series of steps to examine each successive data until a movement of the vehicle is detected. At each start of the loop, the counter increments its count by one (step 260) and the grouping program proceeds to the next input point. For purposes of determining if the vehicle is still in stop mode, the amount of distance moved during the current stationary segment is calculated based on the first input point and current input point at step 270. In step 280, the calculated travel distance is compared with a maximum value of distance ("DMAX"). The DMAX is a predefined value, for example, specified in feet, to represent a distance traveled by the vehicle during a stationary period above which the vehicle is considered to have started to move. Alternatively, or in addition, the velocity component of the current input point is compared with VMAX. If the calculated travel distance is no more than DMAX, and the velocity at the current input point is no more than VMAX (step 280, YES), the current input point is included into the current stationary segment, whereupon the program returns to step 260 in order to proceed with the subsequent input point.

Once the vehicle exceeds VMAX or DMAX (step 280, NO), the immediately preceding input point is assumed to be the last input point of the current stationary segment. At this point, a range of input points, from the first input point to the point immediately preceding the current input point, represents a segment of data during which the vehicle appears to be stationary. Based on these input points, the time interval of the current stationary segment is calculated based on the first and last point of the current stationary segment (step 300). The calculated time interval is compared against a minimum stop duration criterion ("TMIN"). The TMIN is specified in minutes to represent a duration of time within which the stationary time interval is considered a normal traffic stop. For purposes of compensating for traffic stops typically made during driving, the value of TMIN is selected at some positive number; for example, two minutes.

If the vehicle has remained stationary for a predetermined amount of time or greater, the grouping program characterized such interval as a stop made by the field representative either to perform the assigned tasks or for work breaks. Accordingly, if the stopped time interval exceeds TMIN (step 310, YES), the segment of data between the first and last input point is recognized as a valid stationary segment. The start and stop time of the stationary segment is recorded as well as its location. On the other hand, if the vehicle has remained in a stationary mode for less than a predetermined amount of time, the program assumes that such stationary interval as a temporary traffic stop during operation of the vehicle. Accordingly, if the stop time interval is less than TMIN (step 310, NO), the vehicle is regarded to have been in a traffic stop and therefore the input points associated with this stationary interval are recognized as part of a moving segment. In either case (step 310, YES or NO), the program returns to the beginning (step 220) where the next input point is examined. The process of the grouping program is continued until the end of the data is reached. Once the end of input points is reached (step 340, YES), the program terminates in step 350.

Figure 4:
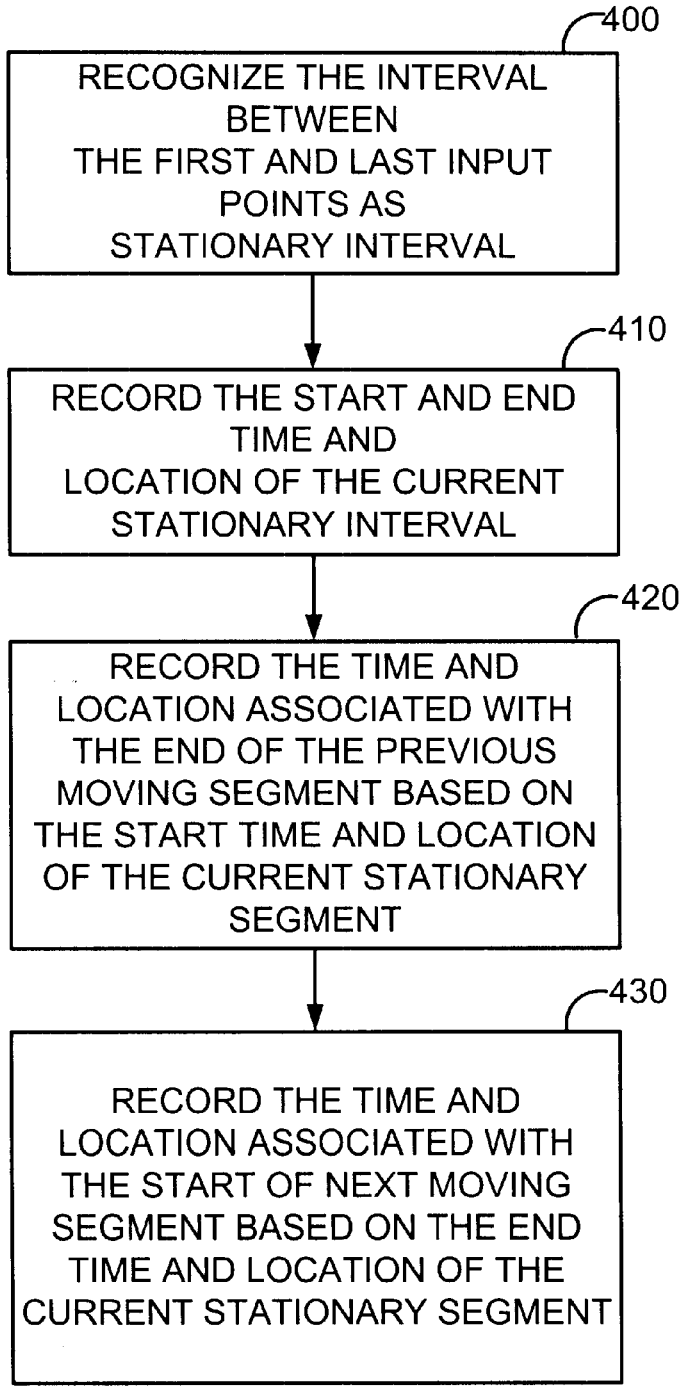
FIG. 4 is a flowchart diagram illustrating a portion of the process of the grouping program in FIG. 3.

In one embodiment, the program is capable of grouping the GPS data into moving and stationary segments by finding only the stationary segments. Referring now to FIG. 4, an expanded flowchart of step 330 of FIG. 3 is shown. The recognition of a stationary interval starts at step 400. The time interval and positional information associated with the recognized stationary segments are not only used to provide information relating to that particular stationary segment but are also used to provide information related to the previous and subsequent moving segments. The recognition of the current stationary segment is accomplished by first recording the start and end time and location corresponding to the input points belonging to the current stationary segment (step 410). Then, in step 420, the time and location associated with the end point of the previous moving segment is recorded, based on the starting time and corresponding location of the current stationary segment. Next, in step 430, the time and location associated with the start of the subsequent moving segment is recorded, based on the ending time and corresponding location of the current stationary segment.

Figure 5:
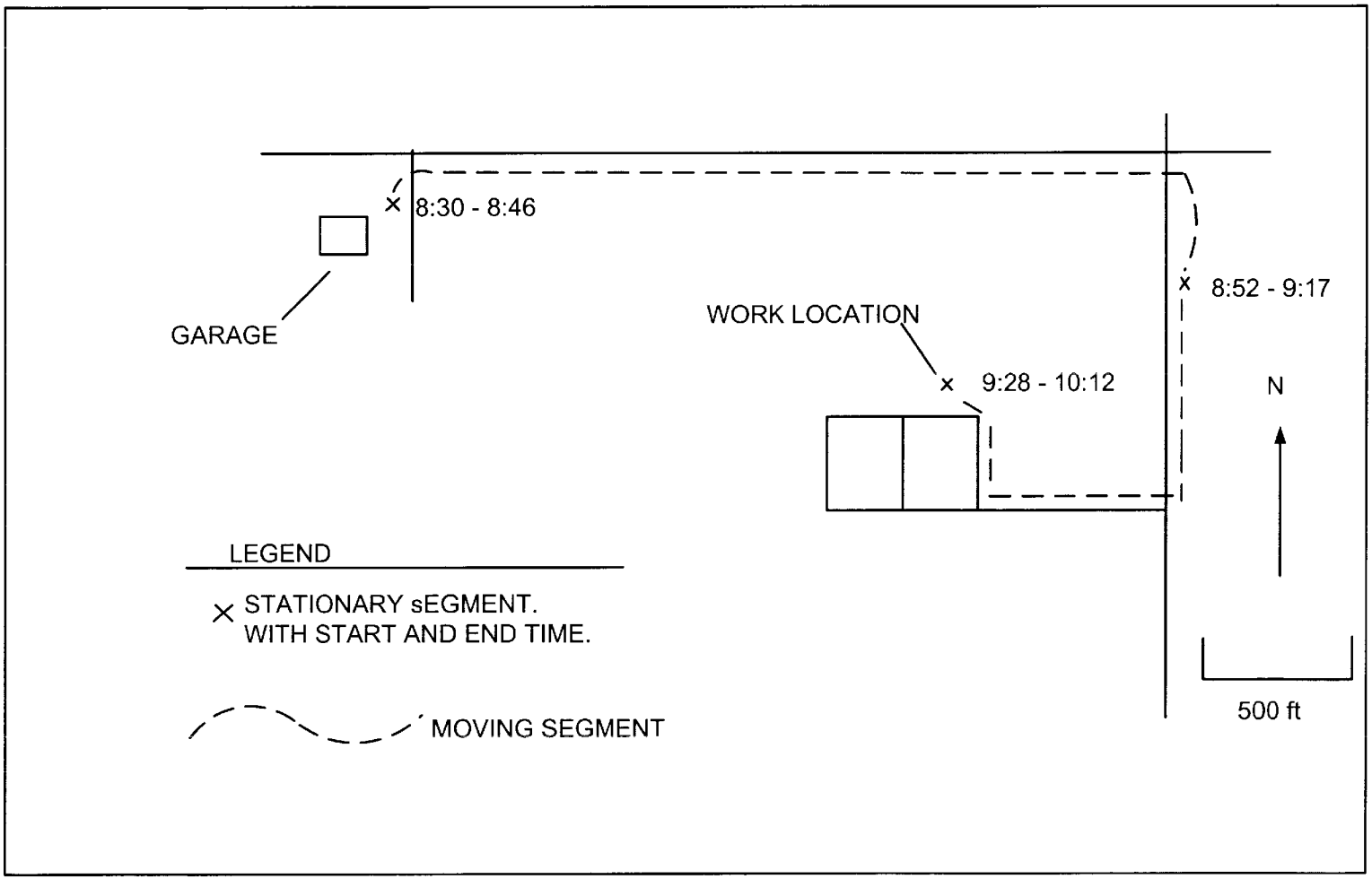
FIG. 5 is an example of a simplified display illustrating moving and stationary intervals for a portion of a field representative's travel presented in map format.

The computer is programmed to present the output results either in map format or report format. The map format presents the processed information so that the stationary and moving segments can be readily observed by a user to facilitate in spotting problems or unusual behavior of their field agents as shown in FIG. 5. In this format, the identified moving and stationary segments are graphically displayed on a display screen using map images stored in the computer memory. An appropriate map image is first selected based on the locations traveled by the associated vehicle. The selected portions of the map image are then retrieved and displayed on the display screen, so that the locations of the stationary segments may be represented by symbols or icons on the map image. The stationary symbols or icons may be labeled with corresponding start and stop times to indicate when the stop is made and how long the stop lasted. The travel routes (moving segments) between the stationary intervals are displayed using the positional data supplied by the GPS receiver. For purposes of providing useful insight into driving habits, the travel routes may be drawn in such a way as to indicate the speed of the vehicle; for example, the travel routes may be color-coded with different colors representing corresponding speed ranges. Other significant information can also be symbolically displayed with the map image, such as information relating to the locations of each job assignment dispatched and completed by the associated field representative, and other selected locations of interest, such as, the location of equipment and parts pickup facility.

The stationary segments may be further characterized to indicate whether a particular stationary segment relates to business or personal purposes. A particular stationary segment may be assumed to be for personal reasons if the location of the stationary segment does not correspond to any of the job assignment locations. In this regard, different icon symbols may be used to indicate different types of stationary segments; for example, one icon symbol may be used to indicate stops made for purposes of performing assigned services, and another icon symbol may be used to indicate stops taken for work breaks The report format is configured to document such information as the time and place the field representative stopped to perform work or take a break as well as the start and stop time and travel path between the stop locations. The report may also document other relevant summary information such as the percentage of time spent driving and the percentage of time spent working at the job site so that a comparison can be readily made. The program may be specifically configured to generate summary information with regard to certain locations of interest, such as, the company's parts and equipment pickup location so that relatively frequent trips made thereto may signal a warning that such field representative may need further training.

The grouping program may further include a user interface presented through display 52 which allows for selection and changing of the predetermined parameters such as VMAX, DMAX and TMIN. In this way, a user may adjust the parameter values such that the output results obtained from the grouping program most accurately reflect the actual stationary and moving segments or such that the output results provide the best understanding of the field representatives' behavior. The user interface may also be configured to permit the user to select the way in which the output results are presented.

It should be noted that in addition to the application in connection with fleet vehicles, the present system may be employed in any situation where periodic positional information and velocity information are available and where it is desirable to identify moving and stationary segments. For example, the present system may be used in tracking animals. In such scenario, a GPS receiver may be attached to the body of an animal to periodically collect positional and velocity data of the animal as it moves from one location to another. In this regard, the grouping program described herein may assist in monitoring the behavior and habits of the animal by allowing a user to readily observe the location and time of the day the animal is resting as well as the travel paths between resting intervals.

The present invention has many other applications. For example, the present system may be used by a person, such as a parent or guardian, for purposes of monitoring and supervising another person, such as a child. In this instance, the GPS unit described herein may be installed within a vehicle of a child. Whereupon, the grouping program may be utilized to process the GPS data and provide further insight into the behavior of the child by observing the identified periods and locations of each stop made by the child. The graphically illustrated results derived by the grouping program may be used by the parent to facilitate in spotting problems or unusual behavior of the child. In addition, the travel paths plotted between stationary segments, color-coded to indicate vehicle speed, may be used to alert parents of problematic driving habits.

While the foregoing preferred embodiments of the invention have been described and shown, it is understood that variations and modifications, such as those suggested, and others within the spirit and scope of the invention, may occur to those skilled in the art to which the invention pertains. The scope of the present invention accordingly is to be defined as set forth in the appended claims.

What is claimed is:

1. A system for processing information with regard to a movable object, comprising:

a GPS receiver to generate GPS data, said GPS data including at least positional information of the movable object;

a memory in connection with said GPS receiver to store the GPS data generated thereby;

a memory interface to receive GPS data from the GPS receiver and store the GPS data in the memory;

a memory in connection with said GPS receiver to store the GPS data generated thereby;

a memory interface to receive GPS data from the GPS receiver and store the GPS data in the memory;

a processor configured to receive the GPS data stored in the memory and group the GPS data into stationary and moving segments, wherein each of said stationary segments corresponds to a portion of the GPS data generated when the movable object is substantially stationary at one location for a defined minimum period of time, and each of said moving segments corresponds to a portion of the GPS data generated when the movable object is moving from one stationary segment location to another stationary segment location; and a user interface in connection with the processor which provides for viewing of said stationary and moving segments, wherein the identified stationary and moving segments are displayed on a map with symbols provided on the map representing the locations of each of the stationary segments and travel paths provided between the symbols using the positional data obtained by the GPS receiver, each of the travel paths representing a respective one of the moving segments.

2. The system of claim 1, wherein the GPS data further includes velocity information of the movable object, and further wherein the processor uses said velocity information to facilitate in grouping of the GPS data into the stationary and moving segments.

3. The system of claim 2, wherein GPS data further includes time information corresponding to a time at which the positional and velocity information is generated.

4. The system of claim 1, further comprising a grouping module configured to:

(a) examine each of the GPS data sequentially to identify a first point in time at which the movable object is moving at less than a predetermined velocity;

(b) examine subsequent GPS data sequentially until a second point in time is identified at which the movable object starts to move at greater than said predetermined velocity;

(c) calculate a time interval elapsed between said first and second points in time;

(d) recognize a portion of the GPS data corresponding to said first and second point in time as one of said stationary segments if said time interval calculated exceeds a predetermined time interval; and (e) repeat (a)–(d) until end of the GPS data is reached.

5. The system of claim 4, wherein said grouping module is further configured to:

record a start time and an end time and a location corresponding to each of the identified stationary segments;

record an end time and a location of a previous moving segment based on the start time and the location of each of the stationary segments; and record a start time and a location of a subsequent moving segment based on the end time and location of each of the stationary segments.

6. The system of claim 4, wherein said grouping module is a software program executable by the processor.

7. The system of claim 4, further comprising a user interface to allow for selection and changing of predetermined parameters used in said grouping module such that the stationary and moving segments obtained from said grouping module most accurately reflect actual stationary and moving segments.

8. The system of claim 1, wherein the identified stationary and moving segments are used to generate a report, said report including information regarding start and stop time and locations of each of the moving segments and of each of the stationary segments.

9. The system of claim 1, wherein the GPS receiver is in connection with the movable object.

10. The system of claim 9, wherein the movable object is a service vehicle and the system is used to monitor a field agent operating the service vehicle to move from one job site to another.

11. The system of claim 1, wherein the movable object is an animal and the system is used to track the animal, the GPS receiver is attached to the body of the animal to periodically collect positional and velocity data as the animal moves from one location to another, and further wherein the system facilitates in monitoring the behavior and habits of the animal by allowing a user to observe the location and time of the stationary segments as well as the paths between the stationary segments.

12. A vehicle monitoring system for collecting and processing travel information of a vehicle, comprising:

a GPS unit, located in the vehicle, including a GPS receiver which periodically generates GPS data, said GPS data including positional and velocity information of the vehicle and time information corresponding to a time at which the positional and velocity information is generated, and a memory operatively coupled to said GPS receiver to store said GPS data provided thereby;

a processing unit remotely located relative to the vehicle, said processing unit configured to receive the positional and velocity information from the GPS unit and group the GPS data into stationary segments and moving segments, each of said stationary segments corresponding to a portion of GPS data generated when the vehicle is substantially stationary at one location for a defined minimum period of time, and wherein each of said moving segments corresponds to a portion of GPS data generated when the vehicle is moving from one stationary segment location to another stationary segment location; and said processing unit is further configured to compile moving and stationary segments such that the moving and stationary segments are displayable on a map with accompanying symbols representing the locations of each of the stationary segments and travel paths provided between the symbols, each of the travel paths representing a respective one of the moving segments.

13. The vehicle monitoring system of claim 12, further comprising a fleet of vehicles and wherein the processing unit is configured to receive and process the GPS data generated by each vehicle in said fleet.

14. The vehicle monitoring system of claim 13, wherein the vehicle monitoring system is used to monitor field agents operating fleet vehicles to move from one job site to another.

15. The vehicle monitoring system of claim 12, wherein each of said GPS unit and said remotely located processing unit further comprises a wireless communication interface to allow the GPS unit to transmit the positional and velocity information stored therein to the processing unit via a wireless communications network.

16. The vehicle monitoring system of claim 12, further comprising a grouping module configured to:

(a) examine each of the GPS data sequentially to identify a first point in time at which the vehicle is moving at less than a predetermined velocity;

(b) examine subsequent GPS data sequentially until a second point in time is identified at which the vehicle starts to move at greater than said predetermined velocity;

(c) calculate a time interval elapsed between said first and second points in time;

(d) recognize a portion of the GPS data corresponding to said first and second point in time as one of said stationary segments if said time interval calculated exceeds a predetermined time interval; and (e) repeat (a)–(d) until end of the GPS data is reached.

17. The vehicle monitoring system of claim 16, wherein the grouping module is a software program executable by the processing unit.

18. The vehicle monitoring system of claim 16, further comprising a user interface in connection with the processing unit to allow viewing of said stationary and moving segments.

19. The vehicle monitoring system of claim 16, further comprising a user interface to allow for selecting and changing of said predetermined velocity and said predetermined time interval used in the grouping module such that the stationary and moving segments obtained therefrom most accurately reflect actual stationary and moving segments.

20. The vehicle monitoring system of claim 16, wherein the grouping module is further configured to:

record a start time and an end time and a location corresponding to each of the identified stationary segments;

record an end time and a location of a previous moving segment based on the start time and the location of each of the stationary segments; and record a start time and a location of a subsequent moving segment based on the end time and location of each of the stationary segments.

21. The vehicle monitoring system of claim 16, wherein the vehicle includes an engine, and an ignition system having an on-mode corresponding to activation of the engine and an off-mode corresponding to deactivation of the engine, the GPS unit is operatively coupled to said ignition system to periodically receive and store information with regard to on/off mode of said ignition system.

22. The vehicle monitoring system of claim 21, wherein the information with regard to the off/on mode of the ignition system in the GPS unit is used by the processing unit to facilitate in identifying the stationary segments.

23. The vehicle monitoring system of claim 12, wherein the identified stationary and moving segments are used to generate a report, said report including information regarding start and stop time and locations of each of the moving segments and of each of the stationary segments.

24. The vehicle monitoring system of claim 23, wherein the report further includes information relating to a percentage of time spent driving versus a percentage of time spent working at job sites.

25. The vehicle monitoring system of claim 12, wherein the vehicle monitoring system is used to monitor a person operating the vehicle, wherein the identified stationary and moving segments provide insight into the behavior of the person.

26. A method of monitoring movement of a remote movable object, comprising:

periodically generating positional information of the movable object at least while the movable object is moving;

storing said positional information of the one movable object;

grouping said positional information of the movable object into moving segments and stationary segments;

wherein each of said stationary segments corresponds to a portion of the GPS data generated when the movable object is substantially stationary at one location for a defined minimum period of time, and each of said moving segments corresponds to a portion of the GPS data generated when the movable object is moving from one stationary segment location to another stationary segment location; and compiling said moving segments and stationary segments such that the moving and stationary segments are displayable on a map with accompanying symbols representing the locations of each of the stationary segments and travel paths provided between the symbols, each of the travel paths representing a respective one of the moving segments.

27. The method of claim 26, wherein each of said stationary segments corresponds to a portion of GPS data generated when the movable object is substantially stationary at one location for a define minimum period of time, and wherein each of said moving segments corresponds to a portion of GPS data generated when the movable object is moving from one stationary segment location to another stationary segment location.

28. The method of claim 27, wherein the positional information is generated and stored by a GPS unit located in the movable object, wherein said GPS receiver is configured to generate velocity information along with the positional information.

29. The method of claim 28, further comprising the step of transferring the data from the GPS unit to a computer performing the grouping step.

30. The method of claim 28, wherein said grouping step further comprises:

(a) examining each of the velocity information sequentially to identify a first point in time at which movable object is moving at less than a predetermined velocity;

(b) examining subsequent velocity information sequentially until a second point in time is identified at which the movable object starts to move at greater than said predetermined velocity;

(c) calculating a time interval elapsed between said first point in time and said second point in time;

(d) recognizing the positional information corresponding to said first and second point in time as one of said stationary segments if said time interval calculated exceeds a predetermined time interval; and (e) repeating steps (a)–(d) until end of the positional and velocity information is reached.

31. The method of claim 30, wherein the step of recognizing further comprises:

recording said first and second point in time and a location corresponding to each of the stationary segments;

recording an end time and a location of a previous moving segment based on said first point in time and the location of each of the stationary segments; and recording a start time and a location of a subsequent moving segment based on said second point in time and the location of each of the stationary segments.

* * * * *